US012703978B2

(12) United States Patent
Kelly

(10) Patent No.: US 12,703,978 B2
(45) Date of Patent: Aug. 11, 2026

(54) WIND RESISTANT RAIN GUTTER ASSEMBLY FOR CREATING PERIMETER VERTICAL AIR BARRIERS

(71) Applicant: Thomas L. Kelly, Waterbury, CT (US)

(72) Inventor: Thomas L. Kelly, Waterbury, CT (US)

( * ) Notice: Subject to any disclaimer, the term of this patent is extended or adjusted under 35 U.S.C. 154(b) by 150 days.

(21) Appl. No.: 18/456,088

(22) Filed: Aug. 25, 2023

(65) Prior Publication Data

US 2024/0392573 A1 Nov. 28, 2024

Related U.S. Application Data

(60) Provisional application No. 63/503,509, filed on May 22, 2023.

(51) Int. Cl.
*E04D 13/072* (2006.01)

(52) U.S. Cl.
CPC ..... *E04D 13/0722* (2013.01); *E04D 13/0725* (2013.01)

(58) Field of Classification Search
CPC ..... E04D 13/0722; E04D 13/0725; E04D 13/0727; E04D 2013/0468
See application file for complete search history.

(56) References Cited

U.S. PATENT DOCUMENTS 2,784,687 A * 3/1957 Hovey ..... E04D 13/064 52/92.1
3,550,381 A * 12/1970 South ..... E04D 13/076 52/12
3,612,453 A * 10/1971 Zimmer ..... E04D 13/0727 248/48.2
4,345,731 A * 8/1982 Rowe ..... E04D 13/0725 52/95
5,638,643 A * 6/1997 Demartini ..... E04D 13/0727 52/11
8,959,853 B2 * 2/2015 Bortell ..... E04D 13/158 52/60
10,883,272 B1 * 1/2021 Ortin ..... E04D 13/155

FOREIGN PATENT DOCUMENTS

DE 29714562 U1 * 10/1997 ..... E04D 13/0727
GB 2321481 A * 7/1998 ..... E04D 13/064
GB 2399097 A * 9/2004 ..... E04D 13/064

* cited by examiner

*Primary Examiner* — Adriana Figueroa
(74) *Attorney, Agent, or Firm* — CANTOR COLBURN LLP

(57) ABSTRACT

A gutter assembly for a structure includes a channel having a hollow interior and a lower attachment member connectable to the structure. The lower attachment member is affixed to a lower surface of the channel and extends continuously over a length of the channel.

16 Claims, 22 Drawing Sheets

WIND RESISTANT RAIN GUTTER ASSEMBLY FOR CREATING PERIMETER VERTICAL AIR BARRIERS

CROSS-REFERENCE TO RELATED APPLICATIONS

This application claims the benefit of U.S. Application No. 63/503,509, filed May 22, 2023, the contents of which are incorporated by reference herein in their entirety.

BACKGROUND

Exemplary embodiments pertain to the art of rain gutters and more specifically to a wind resistance rain gutter assembly.

A traditional gutter trough is configured to catch and channel rainwater from a low sloped building roof. The trough is typically installed by mechanically fastening a top of the trough on a roof drip edge nailer. A gutter horizontal flange is then flashed to the roof with a roof waterproofing membrane. In commercial low sloped flat roofs, a gutter attachment flange secures the roof waterproofing membrane to the horizontal perimeter edge nailers to secure the waterproofing membrane and prevent a peal back of the perimeter edge.

A problem with existing gutter troughs is that they are not secured at their bottom against the primary wind forces flowing up the vertical surface of a building wall. When wind hits a building, it resembles a stream of water rising up the vertical wall of the building with a compressive force of the total height of the wall that the wind was channeled into. This wind flowing along the surface of the wall, develops its strongest force against the square gutter bottom, trying to push it up and out from the building drip edge wall. This wind force over the years, fatigues the gutter top flange fastening system, causing a loss of the gutter trough. The roof waterproofing membrane is also secured to the perimeter nailer edge by the gutter system and is susceptible to wind uplift damage.

Additionally, air infiltration occurs at the backside of a gutter through the nailers and into the structural roof deck. These intersecting wall components have voids that external air infiltrates into the building and roof assembly. These voids increase over the years with building movements and expansion and contraction become a tremendous energy loss of internal building heated or air-conditioned air.

A type of building construction that recognizes a vertical wall to horizontal roof deck assembly air infiltration problem, is in freezer buildings and high humidity paper mills, food processing, etc. construction. To address air infiltration and expansion and contraction in a freezer building or a high humidity, food processing/swimming pool internal environment, a two-foot wide (or greater) sprayed in place foam wedge is installed on the underside of the horizontal roof deck to vertical wall angle change, to stop air infiltration and thermal transmissions causing condensation. The roof to wall angle change air infiltration, noticeable on freezer and high humidity food processing buildings, is an energy loss and mold and fungus growth area for all buildings. However, the internal spray foam wedge does not stop under gutter air infiltration Air infiltration is compounded with conventional gutter/trough systems that channel positive pressure air into underside of the gutter when direct winds act on the windward face of a building. Additionally, when the wind egresses over the leeward side of the building over the gutter edge, a "vacuum vortex" takes place under the gutters that sucks internal building heat controlled and cooled conditioned air out of the building through this roof to wall angle change. The perimeter edge design can be the primary energy loss for any building.

BRIEF DESCRIPTION

According to an embodiment, a gutter assembly for a structure includes a channel having a hollow interior and a lower attachment member connectable to the structure. The lower attachment member is affixed to a lower surface of the channel and extends continuously over a length of the channel.

In addition to one or more of the features described above, or as an alternative, in further embodiments the lower attachment member is integrally formed with the channel.

In addition to one or more of the features described above, or as an alternative, in further embodiments the lower attachment member includes a first member and a second member separated by a clearance and a sealant layer is arranged within the clearance.

In addition to one or more of the features described above, or as an alternative, in further embodiments the channel and the lower attachment member are formed from a bent piece of sheet metal.

In addition to one or more of the features described above, or as an alternative, in further embodiments the lower attachment member is removably coupled to the channel.

In addition to one or more of the features described above, or as an alternative, in further embodiments the lower attachment member includes a first portion and a second portion. The first portion is affixed to the lower surface of the channel and the second portion is connectable to the structure.

In addition to one or more of the features described above, or as an alternative, in further embodiments the first portion and the second portion are integrally formed.

In addition to one or more of the features described above, or as an alternative, in further embodiments the channel further comprises a back wall and a front wall and the first portion is affixed to the front wall.

In addition to one or more of the features described above, or as an alternative, in further embodiments the channel includes a back wall, a front wall, and a bottom wall extending between the back wall and the front wall. The first portion is affixed to the bottom wall.

In addition to one or more of the features described above, or as an alternative, in further embodiments including a connector extending from the lower surface of the channel. The first portion has a bent configuration defining a clearance and at least a portion of the connector is arranged within the clearance.

In addition to one or more of the features described above, or as an alternative, in further embodiments including a plurality of fasteners for connecting the lower attachment member to the structure.

In addition to one or more of the features described above, or as an alternative, in further embodiments including a sealant arranged at a surface of the lower attachment member facing towards the structure.

According to an embodiment, a building includes a vertical wall and a gutter assembly mounted to the vertical wall. An interface between the gutter assembly and the vertical wall is sealed such that wind cannot flow between the gutter assembly and the vertical wall.

In addition to one or more of the features described above, or as an alternative, in further embodiments the gutter assembly includes at least one attachment member for mechanically affixing the gutter assembly to the vertical wall.

In addition to one or more of the features described above, or as an alternative, in further embodiments the gutter assembly includes a channel and the at least one attachment member includes a lower attachment member connected to a bottom of the channel.

In addition to one or more of the features described above, or as an alternative, in further embodiments the lower attachment member is integrally formed with the channel.

In addition to one or more of the features described above, or as an alternative, in further embodiments the lower attachment member includes a first member and a second member separated by a clearance and a sealant layer is arranged within the clearance.

In addition to one or more of the features described above, or as an alternative, in further embodiments the lower attachment member is removably connected to the channel.

In addition to one or more of the features described above, or as an alternative, in further embodiments the channel includes a back wall and a front wall and the lower attachment member is coupled to the front wall.

In addition to one or more of the features described above, or as an alternative, in further embodiments the channel includes a back wall, a front wall, and a bottom wall extending between and connecting the back wall and the front wall. The lower attachment member is coupled to the bottom wall.

BRIEF DESCRIPTION OF THE DRAWINGS

The following descriptions should not be considered limiting in any way. With reference to the accompanying drawings, like elements are numbered alike.

DETAILED DESCRIPTION

A detailed description of one or more embodiments of the disclosed apparatus and method are presented herein by way of exemplification and not limitation with reference to the Figures.

As will be shown in the figures, in some embodiments the disclosed gutter assembly provides a lower securement strip that can be sealed, such as with mastic and/or gum strips for example, to an adjacent vertical wall to create an air seal, thereby improving the energy performance of the overall building.

Some of the embodiments disclosed herein provide a gutter trough with a triangular or trapezoidal channel, both of which may have portions that define a "V" shaped channel instead of a square or "U" shaped channel of a box type gutter. The "V" shaped channel is configured force air flow up the wall, outwardly forcing the gutter into the wall, causing less wind stress on the gutter. A mastic sealant is installed in the sealing strip space between the front and back securement areas for fastener holes to be drilled through, which will prevent air infiltration in this area under the gutter. In some embodiments, an angle channel design can be an add-on to a conventional box gutter to divert air flow up the wall and to secure the front face of the box gutter to the building vertical wall.

The gutter may be manufactured from wood, sheet metal, extruded metal, or plastic. The gutter has a trough wall or body that defines a first wall portion. The gutter has an upper end that is utilized as a fastening flange for fastening to a vertical drip edge facia or structure (for simplicity, a vertical drip edge) of a roof of a building.

Figure 1A:
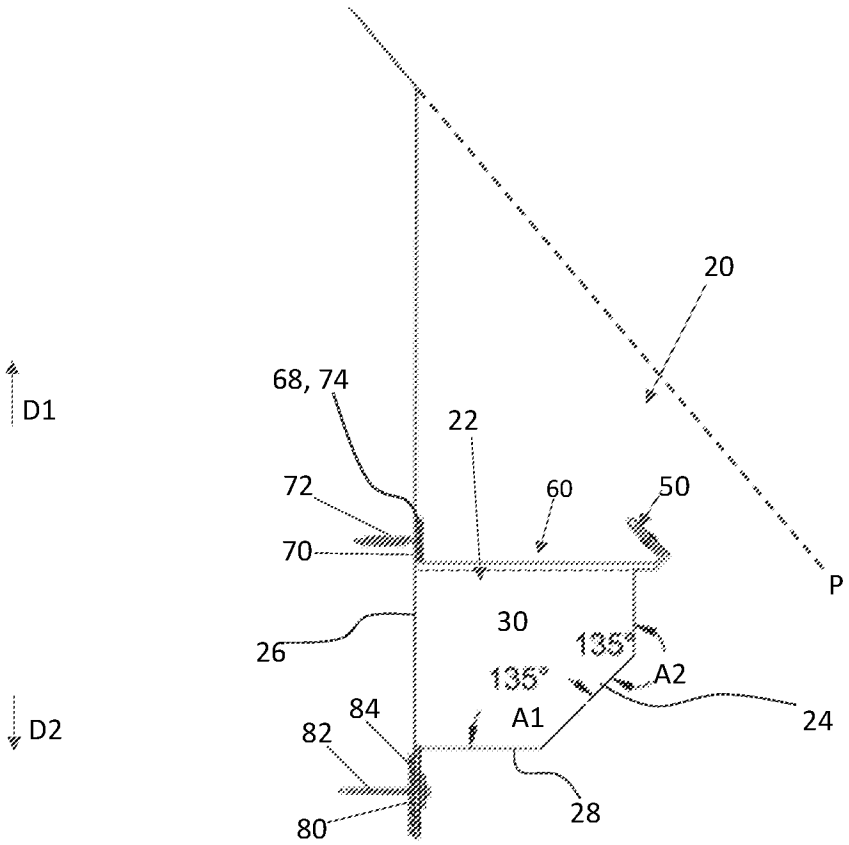
FIG. 1A is a side view of a gutter assembly according to an embodiment.
Figure 1D:
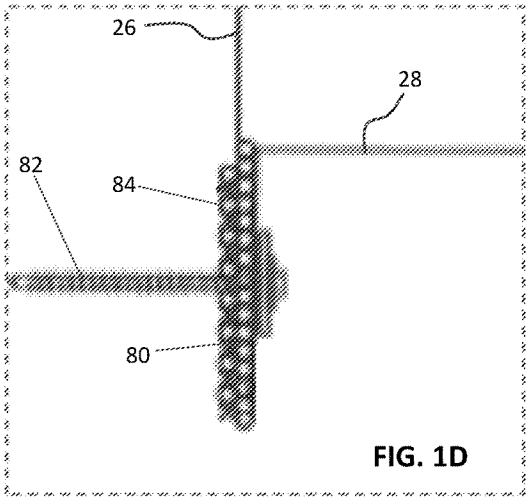
FIG. 1D is a side view of a second detail of the t gutter assembly of FIG. 1A, showing a lower support according to an embodiment.
Figure 7:
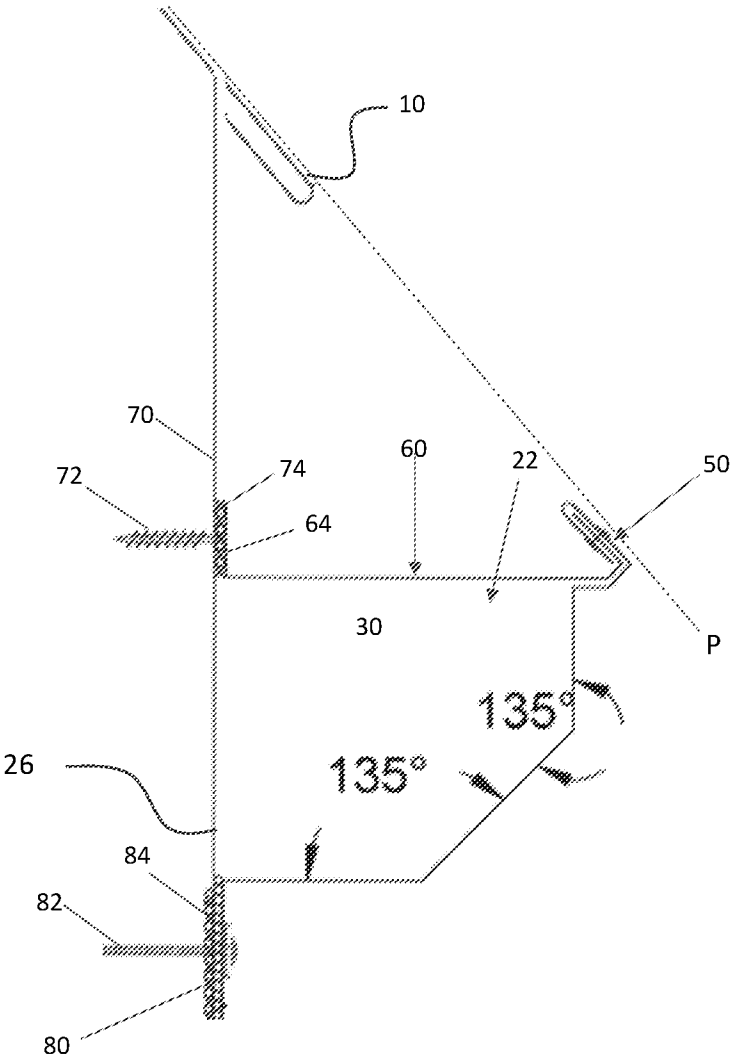
FIG. 7 is a side view of a gutter assembly positioned relative to an extended drip edge according to another embodiment.

Referring now to the FIGS., various examples of a gutter assembly 20 are illustrated in more detail. As shown the gutter assembly 20 is positionable about an exterior surface of a structure, such as vertically underneath and in alignment with a drip edge of the roof of the building for example. In an embodiment, the drip edge of the roof is represented at 10, and it may (FIG. 7) or may not (FIG. 1A) protrude beyond the adjacent exterior surface of a vertical wall of the building or structure.

A gutter assembly 20 includes a trough or channel 22. In the illustrated, non-limiting embodiment, a cross-sectional shape of the channel 22 is substantially uniform over the length of the channel 22. However, embodiments where the cross-section of the channel 22 varies over a length of the channel 22 are also contemplated herein. The channel 22 is formed from a plurality of walls including at least a front wall 24 configured to protrude outwardly from a building and a back wall 26 configured to abut against an exterior surface of a structure. In some embodiments, the channel 22 includes a bottom wall 28 connecting the front wall 24 and the back wall 26. It should be appreciated that although not shown, the channel 22 extends longitudinally such that a first side wall (not shown) and a second, opposite side wall (not shown) are connected to the front wall 24, the back wall 26, and the bottom wall 28 (when present), at opposite ends of the channel 22, respectively, to define the ends of the channel 22.

In an embodiment, the front wall 24, back wall 26, and in some embodiments the bottom wall 28, of the channel 22 are integrally formed. However, embodiments where the front wall 24 and/or the back wall 26 are separate from and connected to the bottom wall 28 are also within the scope of the disclosure. As shown, the front wall 24, the back wall 26, and in some embodiments the bottom wall 28, cooperate to form a hollow interior 30 of the channel 22. In an embodiment, a top or upper end of the channel 22 is open such that water dripping from the drip edge 10 of a roof may fall into the interior 30 of the channel 22.

In some embodiments, at least a portion of the front wall 24 is oriented substantially parallel to the back wall 26. For example, as shown in FIGS. 8, 10, 11, 12 and 13 the channel 22 of the gutter assembly 20 has a generally rectangular, or even square profile. However, in other embodiments, the front wall 24 may be arranged at a non-parallel angle to the back wall 26. For example, in the illustrated, non-limiting embodiment of FIG. 1A, the channel 22 has a generally trapezoidal profile. As shown in FIGS. 1A, 1E, 2 and 7, the front wall 24 includes an angular portion 32 having a first end that extends at an angle from the bottom wall 28 and a top wall 34 connected to a second end of the angular portion 32. In an embodiment, the top wall 34 is oriented substantially perpendicular to the bottom wall 28 However, embodiments where the top wall 34 is arranged at another angle are also contemplated herein. Interior angles A1, A2 defined between the bottom wall 28 and the angular portion 32 and the between the top wall 34 and the angular portion 32, respectively, may but need not be equal. In an embodiment, the interior angles A1, A2 are about 135°. However, embodiments where one or more of the interior angles A1, A2 is greater or smaller than 135° are also contemplated herein.

Figure 3:
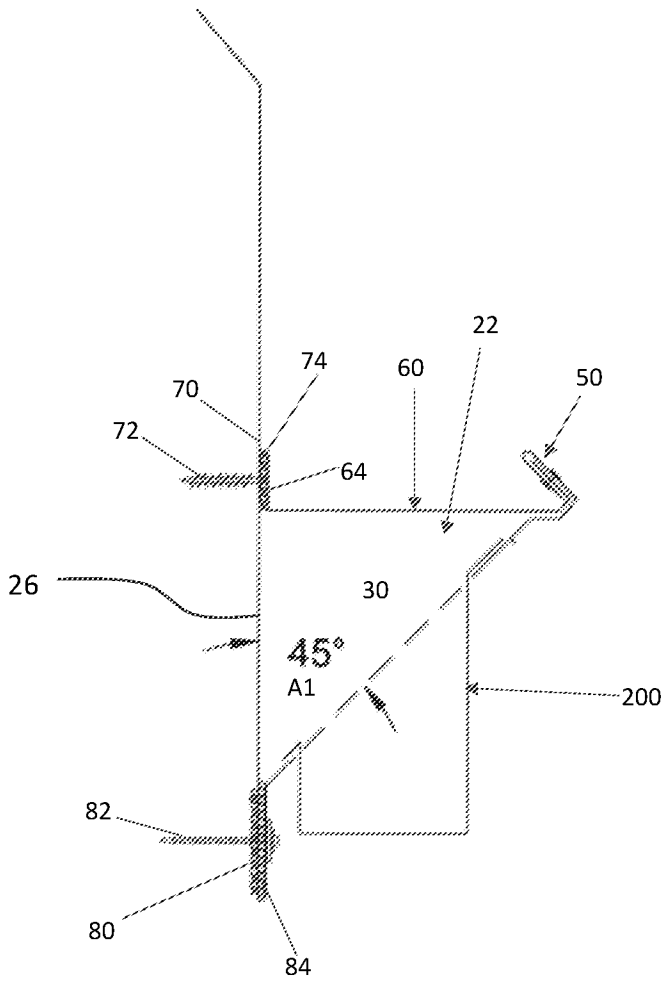
FIG. 3 is a side view of a gutter assembly having a triangular profile according to another embodiment.
Figure 4:
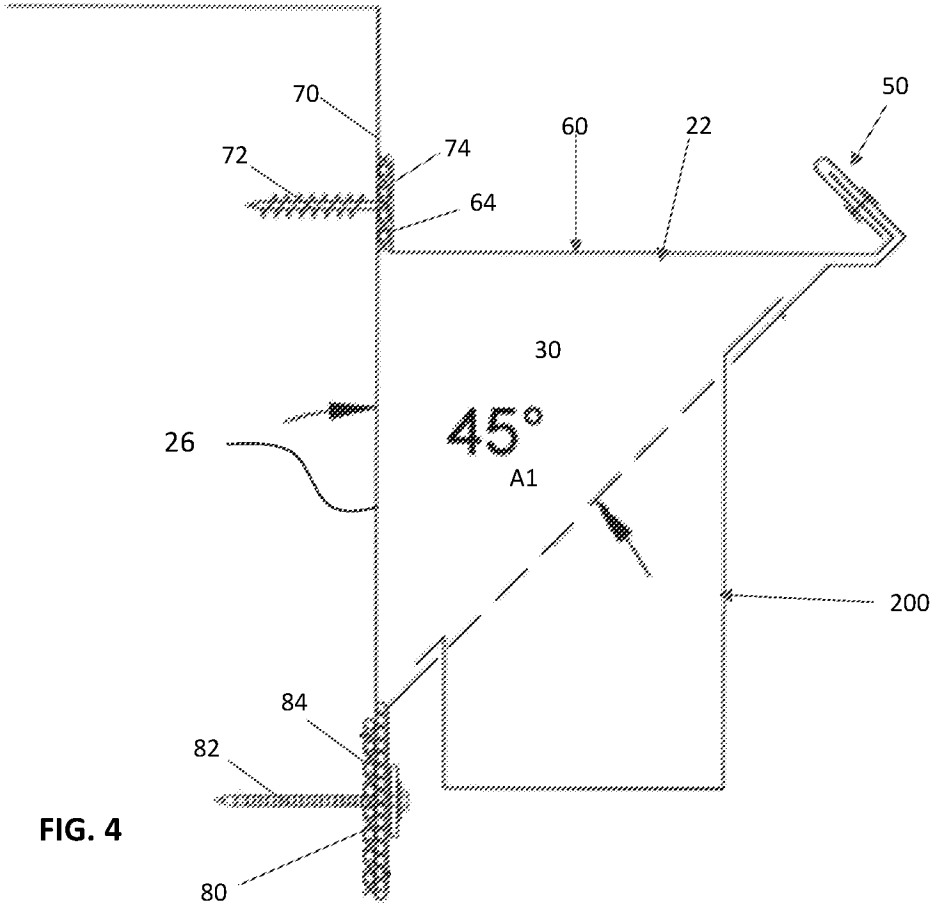
FIG. 4 is a side view of a gutter assembly having a triangular profile and including an upper attachment member having a right angle according to an embodiment.
Figure 5:
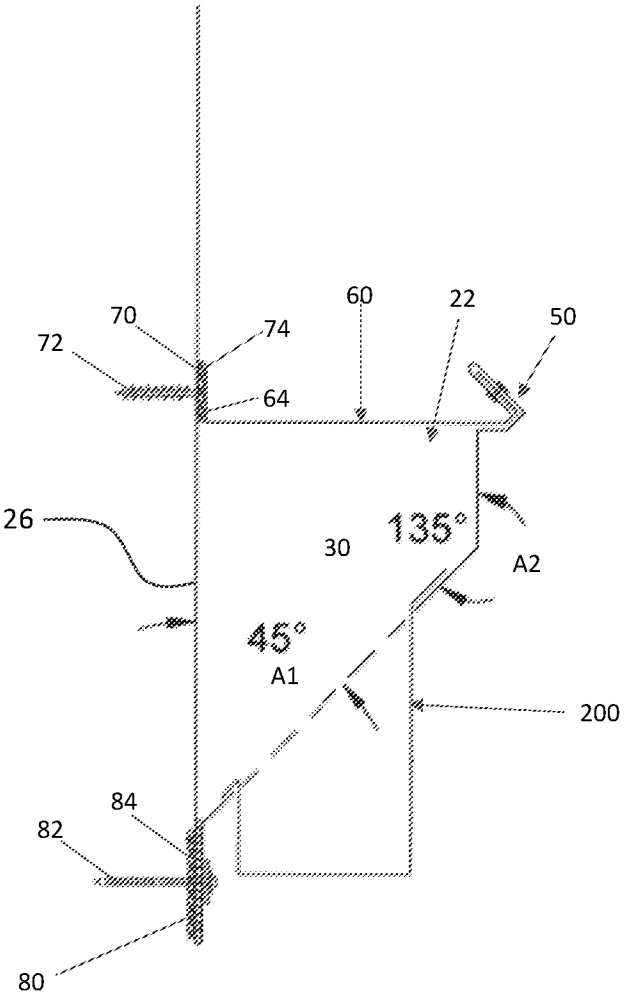
FIG. 5 is a side view of a gutter assembly having a trapezoidal profile and a drop tube according to another embodiment.
Figure 6:
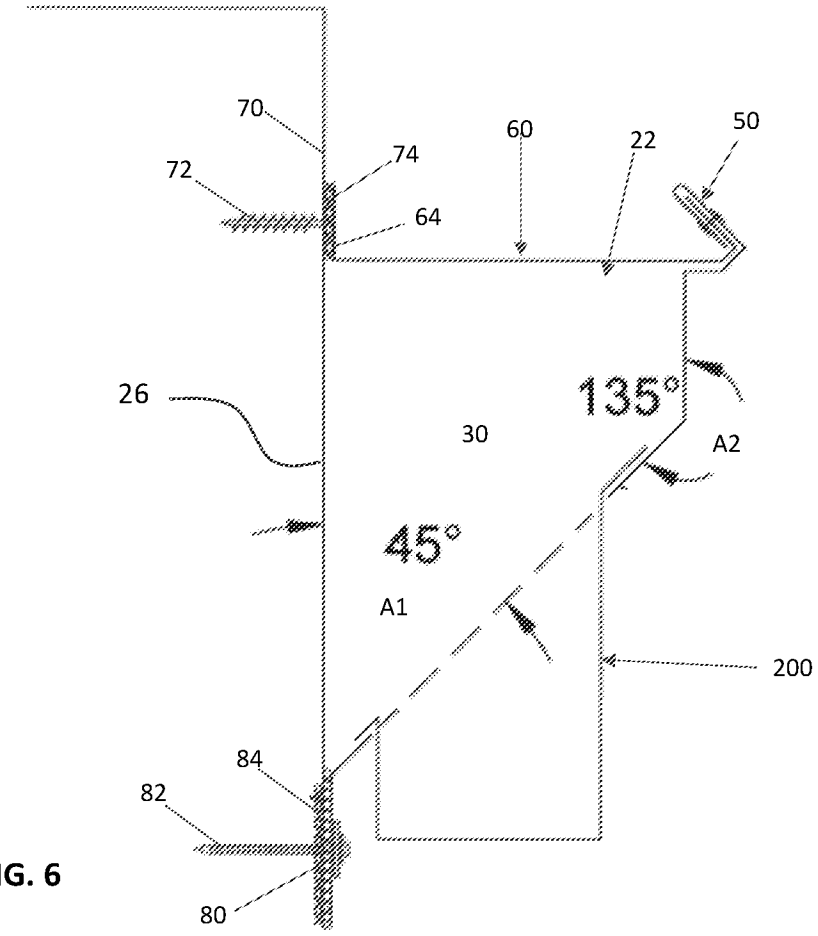
FIG. 6 is a side view of a gutter assembly having a trapezoidal profile and including an upper attachment member having a right angle according to an embodiment.

In other embodiments, such as shown in FIGS. 3 and 4, the front wall 24 is directly connected to the back wall 26. In such embodiments, the channel 22 does not include a bottom wall 28. In some embodiments, the front wall 24 is formed by only an angular portion 32. The angular portion 32 may extend between a bottom and a top of the channel 22. The resulting angle formed between the back wall 26 of the channel 22 and the front wall, such as the angular portion 32 of the front wall 24 for example, is less than 90°, such as 45° for example. In other embodiments where angular portion 32 directly interfaces with the back wall 26, the front wall 24 may additionally include a top wall 34 such that the angular portion 32 is offset from the top of the channel 22 by the top wall 34, as shown in FIGS. 5 and 6. In such embodiments, the resulting angle A2 defined between the angular portion 32 and the top wall 34 may be greater than 90°, such as 135° for example.

Forming at least a portion of the front wall 24 of the channel 22 with an angled surface facilitates the positioning of the channel 22 against a building wall. As a wind uplift force travels up the building wall, the wind will be more easily directed away from the channel 22 by an angled surface. In addition, as the wind passes the angled surface, the wind will apply a normal force to the front wall 24, pushing the back wall 26 of the channel 22 into the building.

Figure 1C:
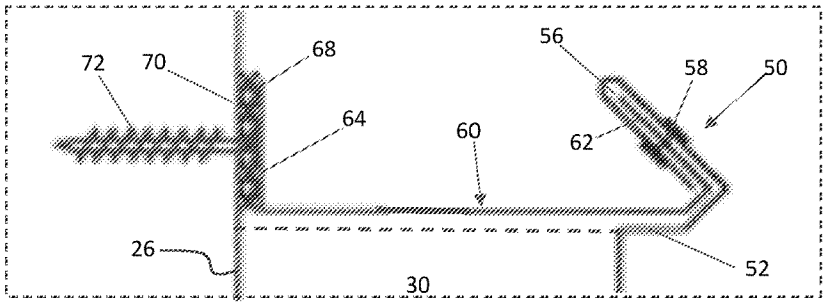
FIG. 1C is a side view of a third detail of the gutter assembly of FIG. 1A, showing a bracket according to an embodiment.

Regardless of the geometric shape of the channel 22, one or more stiffening features 40, may be formed in a portion of the channel 22, such as in the front wall 24 for example, to increase the overall strength and rigidity of the channel 22. In an embodiment, best shown in FIG. 1G, at least one V-shaped protrusion 40 is arranged over a height of the front wall 24 and extends forward therefrom. However, any suitable stiffening features 40 arranged at any location about the gutter assembly 20 is within the scope of the disclosure.

Figure 1B:
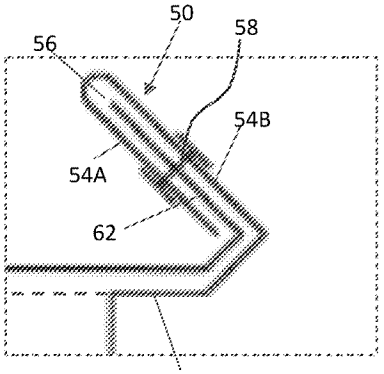
FIG. 1B is a side view of a first detail of the gutter assembly of FIG. 1A, showing an outer lip according to an embodiment.
Figure 1E:
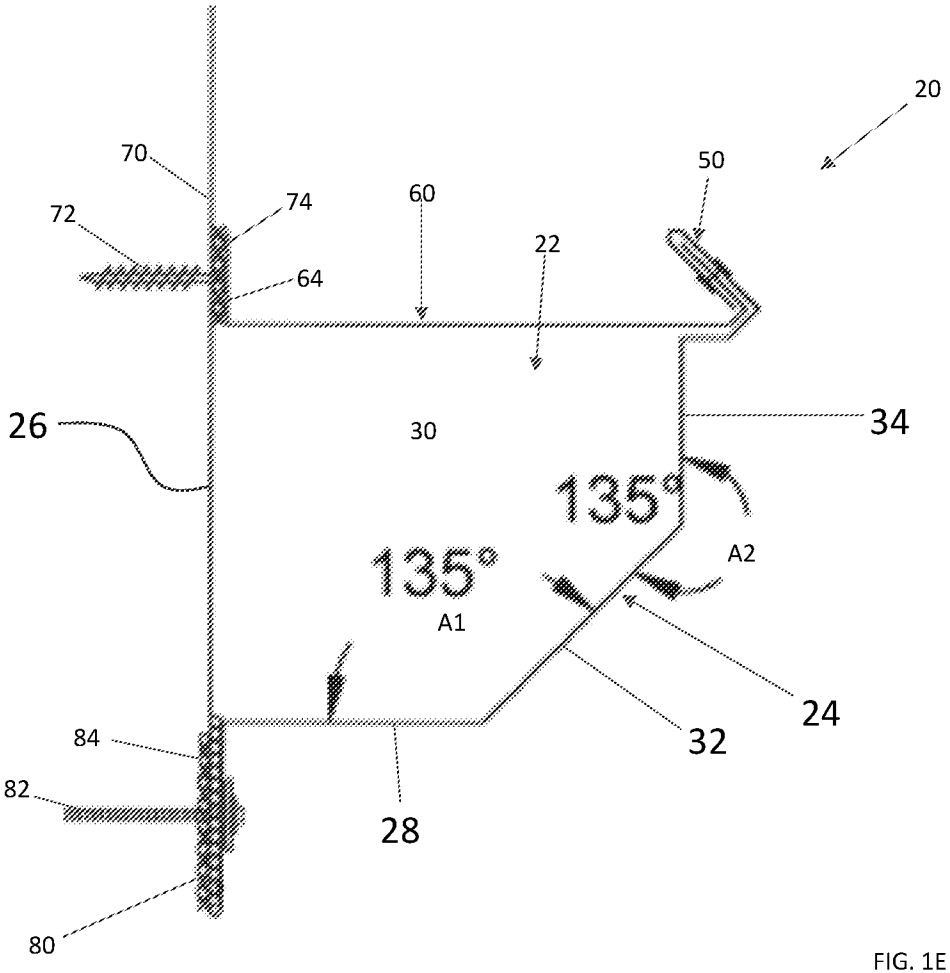
FIG. 1E is a side view of a fourth detail of the gutter assembly of FIG. 1A, where the channel has a trapezoidal profile according to an embodiment.
Figure 1F:
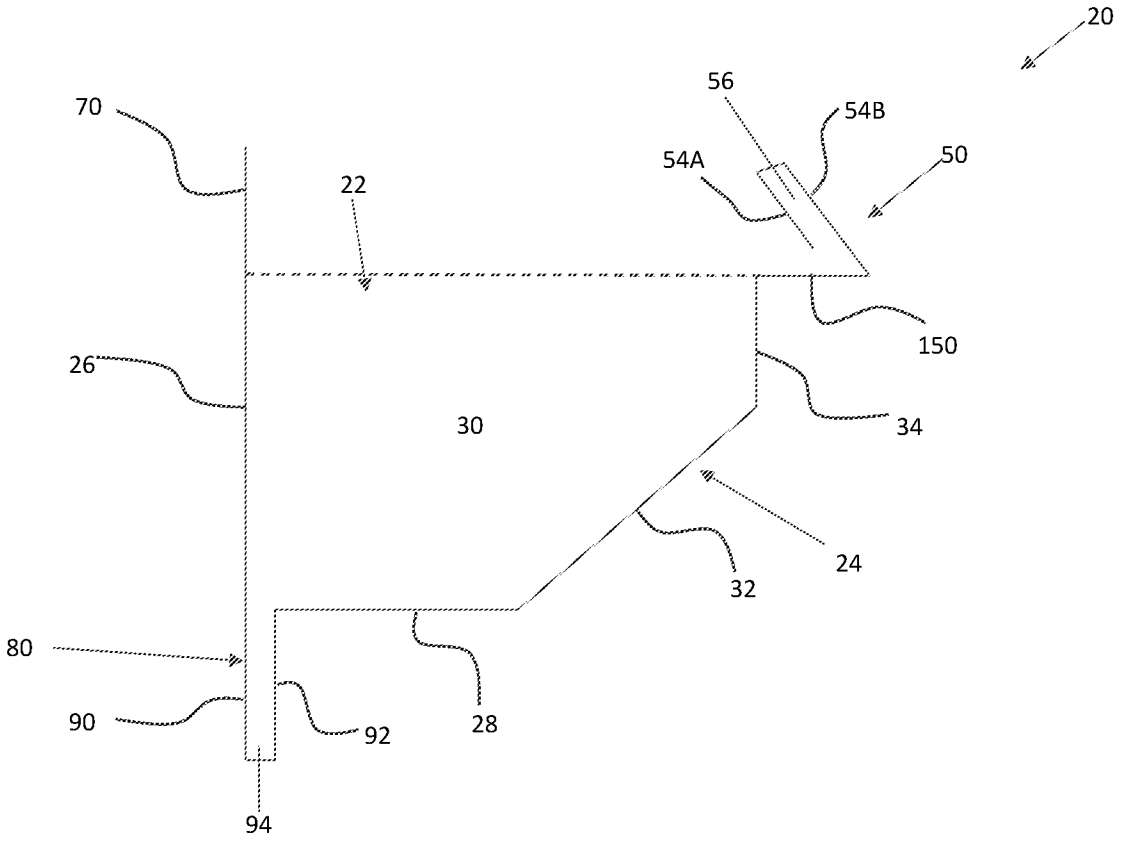
FIG. 1F is a side view of a detail of the gutter assembly of FIG. 1A, without the strap according to an embodiment.
Figure 1G:
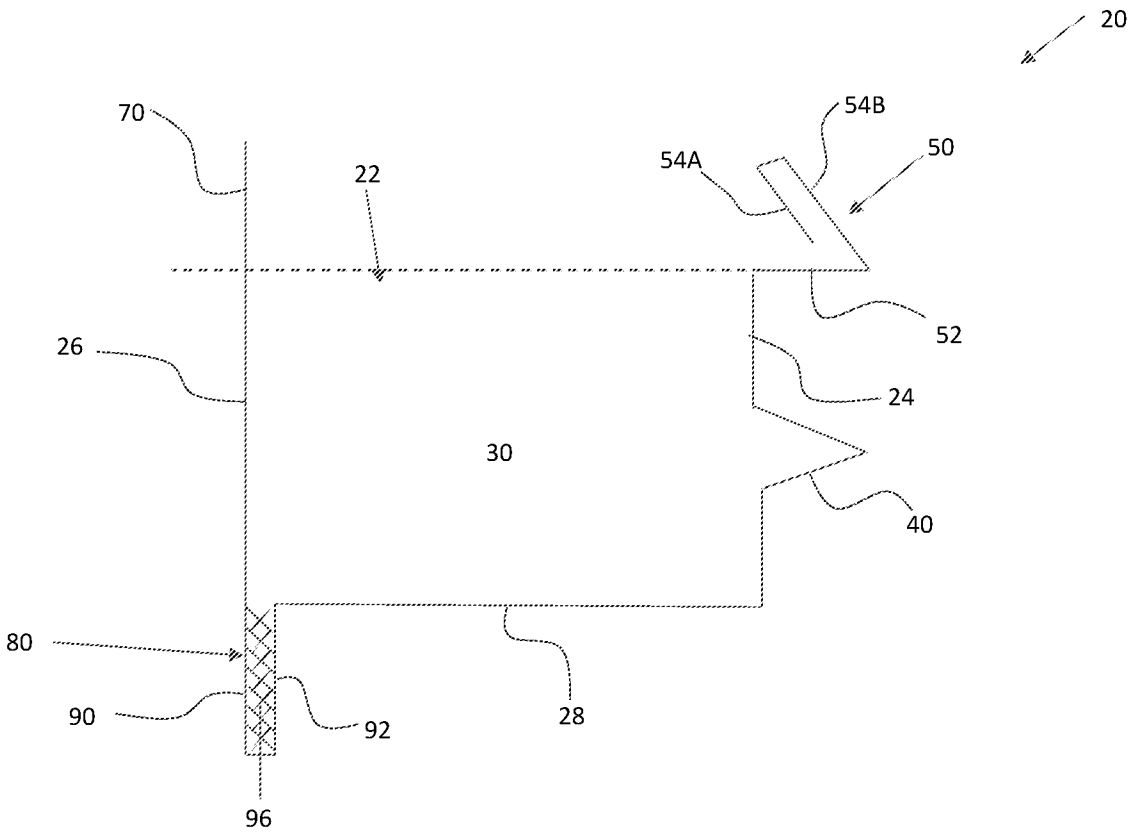
FIG. 1G is a side view of a detail of the gutter assembly of FIG. 1A, including a stiffener formed in the channel according to an embodiment.
Figure 2:
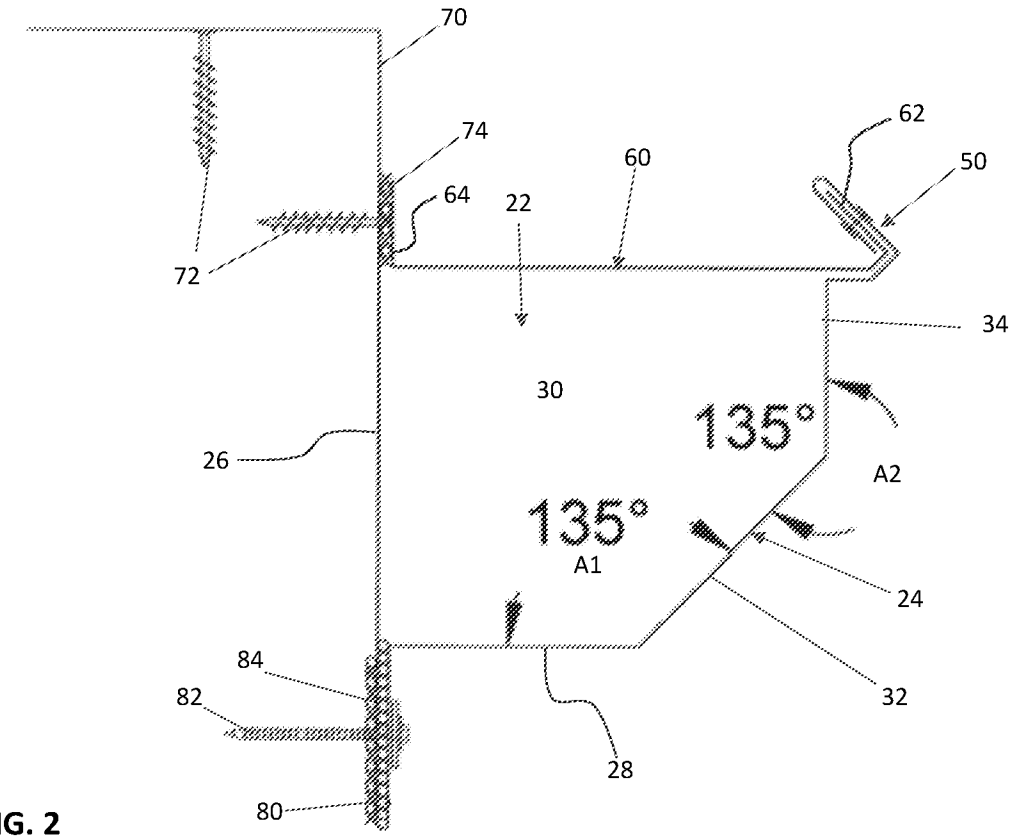
FIG. 2 is a side view of another gutter assembly according to another embodiment.

With reference now to FIG. 1B, the channel 22 may include a lip 50 arranged near the top of the front wall 24. In the illustrated, non-limiting embodiment, a flange 52 protrudes from an upper end of the front wall 24, such as in a direction away from the back wall 26 for example. The lip 50 may be connected to a distal end of the flange 52 and may extend upward, such as at an angle towards the plane of the back wall 26 for example, from the top of the channel 22. When the gutter assembly 20 is mounted to a building, the lip 50 may be arranged at a height generally below the plane P (see FIG. 1A) of the angle of the drip edge 10 to facilitate the egress of wind-blown debris, snow, and ice over the front wall 24 of the channel 22. In the illustrated, non-limiting embodiment, the lip 50 includes a plurality of layers of material stacked along an axis. For example, in the embodiment illustrated in FIG. 1B, the lip 50 has an inner layer 54A and an outer layer 54B separated from one another, the plurality of layers being formed by bending a segment thereof about at least one axis such that the lip 50 is generally folded onto itself.

Figure 16:
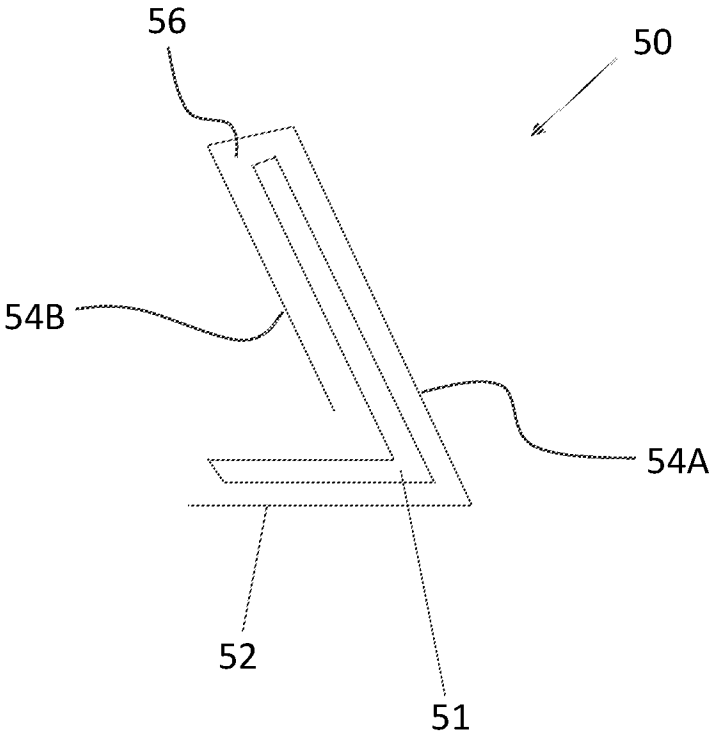
FIG. 16 is a side view of a lip of a gutter assembly including a stiffener according to an embodiment.
Figure 17:
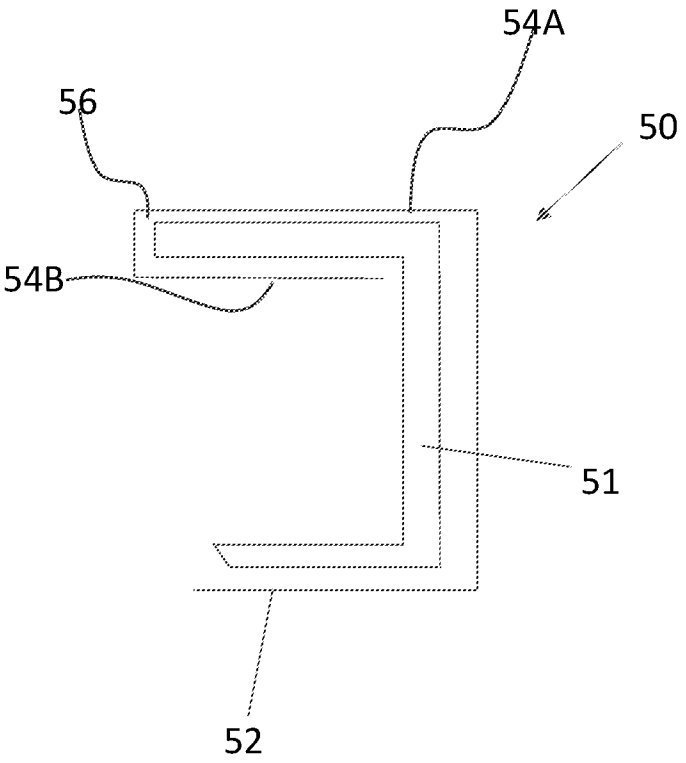
FIG. 17 is a side view of a lip of another gutter assembly including a stiffener according to an embodiment.

A clearance or receiving channel 56 may be formed between the layers 54A, 54B of the lip 50. With reference now to FIGS. 16 and 17, a stiffener, illustrated schematically at 51, may be operably coupled to the lip 50. For example, in an embodiment, a stiffener 51 may be arranged withing the receiving channel 56. In such embodiments, the stiffener 51 may but need not have a contour complementary to the receiving channel. A stiffener 51 formed form any suitable material, such as metal like steel, plastic, or a composite for example, is within the scope of the disclosure.

With continued reference to FIG. 1B, and further reference to FIG. 1C, in an embodiment a distal end 62 of a strap 60, is receivable within the receiving channel 56. In such embodiments, the distal end 62 of the strap 60 may be oriented substantially parallel to at least one layer of the lip 50. A fastener 58 may be used to retain the end 62 of the strap 60 in position relative to the lip 50. However, in some embodiments, the geometry of the distal end 62 of the strap 60 may be sufficient to restrict unwanted movement of the strap 60 relative to the channel 22.

Figure 11:
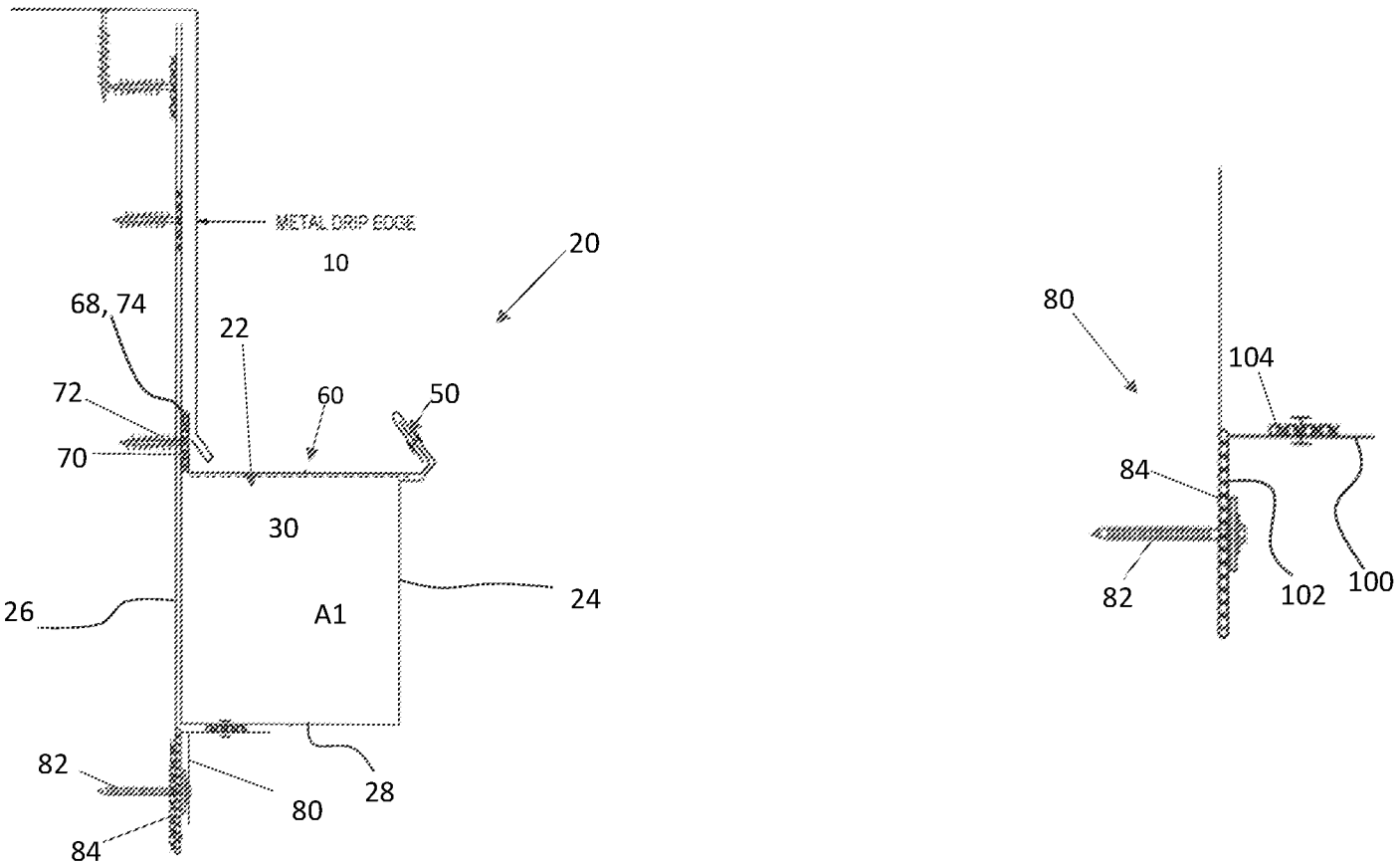
FIG. 11 is a side view of a gutter assembly having an integral upper and lower attachment member according to another embodiment.

The gutter assembly 20 may include at least one attachment member for affixing to a building. With continued reference to FIG. 1A, a first or upper attachment member 70 may extend from the channel 22 in a first direction D1, such as vertically upward for example. Further, the upper attachment member 70 may but need not be continuous over the length of the channel 22. In an embodiment, the upper attachment member 70 is positionable in overlapping arrangement with a portion of the drip edge structure 10 of a roof (see FIGS. 11 and 12). Accordingly, a configuration of the upper attachment member 70 may vary based on the configuration of the roof and/or drip edge 10. For example, as best shown in FIG. 11, at least one of the upper attachment member 70 and the drip edge 10 may be elongated. In other embodiments, the upper attachment member 70 may have at least one bend formed therein. As shown in FIGS. 2, 4, 6, and 9 in an embodiment, the upper attachment member 70 has a right angle formed therein.

In the illustrated, non-limiting embodiment, the upper attachment member 70 extends from a top or first end of the back wall 26 of the channel 22 and is operable to secure the gutter assembly 20 to a wall of a structure and/or to a drip edge 10 of a building's roof for example. At least a portion of the upper attachment member 70 may be coplanar with the back wall 26 of the channel 22. Further, the upper attachment member 70 may be integral with the channel 22 or may be a separate component removably or permanently affixed thereto. In the illustrated, non-limiting embodiment, best shown in FIG. 1A, one or more fasteners 72, such as screws for example, couple the upper attachment member 70 of the gutter assembly 20 to a wall, such as at the exterior surface 12 of a vertical wall of a structure and/or a nailer of the building roof structure. In an embodiment, the fasteners 72 are spaced, equidistantly or non-uniformly, over an axial the length of the gutter assembly 20. Alternatively, or in addition to the one or more fasteners 72, a mastic sealant and/or tape 74 may be used to seal the upper attachment member 70 to the wall.

Figure 15:
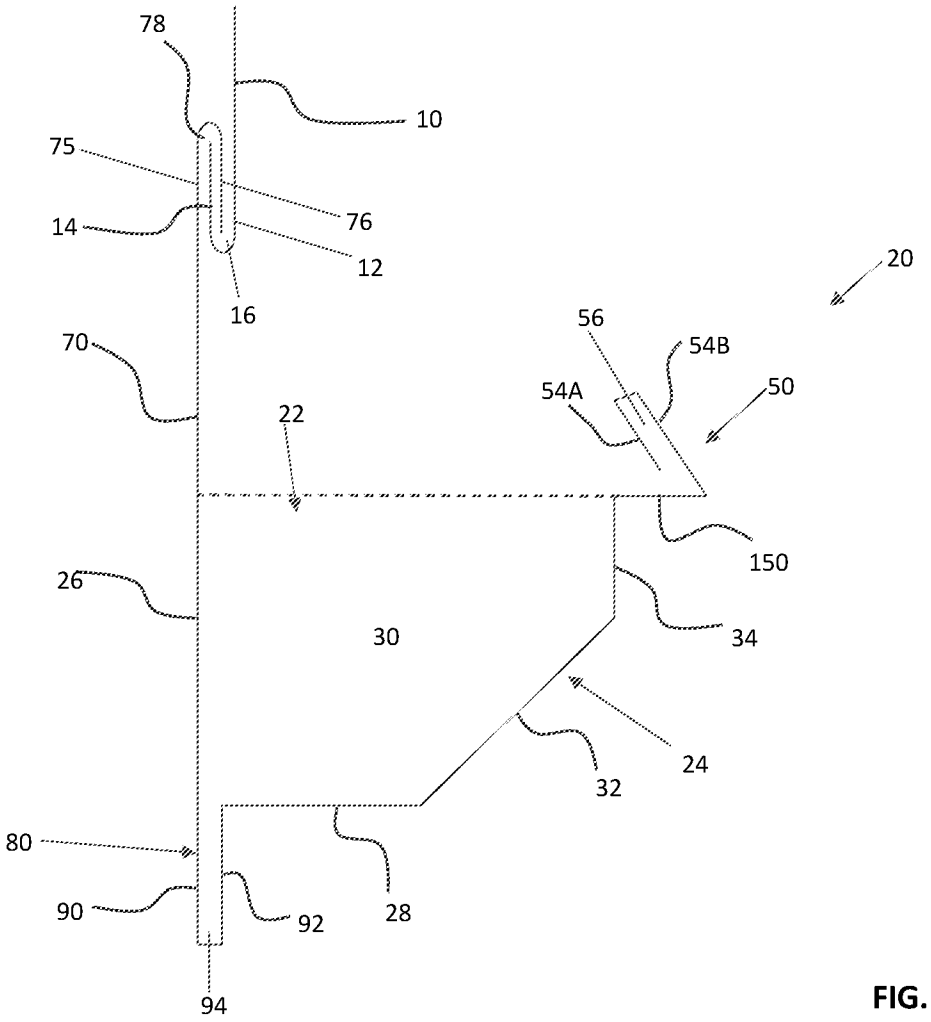
FIG. 15 is a side view of a gutter assembly including an upper attachment member having a bent configuration according to yet another embodiment.

With reference to FIG. 15, in some embodiments the distal end of the upper attachment member 70 is bent to form a C or U-shaped portion with two legs 75, 76 separated by a clearance 78. In such embodiments, the end of the drip edge 10 may have a complementary folded configuration, including first and second legs, 12, 14 and a clearance formed therebetween 16. Accordingly, the leg 76 of the upper attachment portion is positionable within the clearance 16 of the drip edge 10 and the leg 14 of the drip edge is receivable within the clearance 78. Through this meshing engagement, motion of the distal end of the upper attachment member 70 relative to the drip edge 10 is limited.

The previously described strap 60 is positionable over the first open end of the channel 22 and extends from the lip 50 to a location generally adjacent to the back wall 26 and/or upper attachment member 70. The strap 60 may be oriented generally parallel to the open end of the channel 22, or alternatively, may be arranged at an angle relative to the channel 22. As shown, the strap 60 includes a flange 64 arranged at second end thereof, opposite end 62 receivable within the lip 50. The flange 64 may be arranged at an angle to the central portion of the strap 60. In an embodiment, when the bracket is mounted to the channel 22, the flange 64 is oriented substantially parallel to the upper attachment member 70. In an embodiment, a strap sealant layer 68 is provided between an adjacent surface of the upper attachment member 70 and the flange 64. The sealant layer 68 may be mastic, gum strips, or another suitable adhesive. Alternatively, or in addition, the at least one fastener 72 may be used to mechanically affix the second end 64 of the strap 60 to the upper attachment member 70 and/or the building wall.

Alternatively, or in addition to the upper attachment member 70, the gutter assembly 20 includes a second or lower attachment member 80 extending from the channel 22 in a second direction D2, such as vertically downward for example. In the illustrated, non-limiting embodiment, the lower attachment member 80 is arranged adjacent to a bottom surface or underside of the channel 22 and is operable to secure the gutter assembly 20 to a wall, such as to the wall adjacent to the drip edge of the building's roof for example. The lower attachment member 80 may be at least partially coplanar with the back wall 26 of the channel 22. Further, the lower attachment member 80 may be integrally formed with the channel 22, or alternatively, may be a separate component coupled thereto. In the illustrated, non-limiting embodiment, best shown in FIG. 1A, one or more fasteners 82, such as screws for example, couple the lower attachment member 80 of the gutter assembly 20 to a wall, such as the exterior surface of a vertical wall of a building. In an embodiment, the plurality of fasteners 82 are spaced, equidistantly or non-uniformly, over an axial length of the channel 22. Alternatively, or in addition to the one or more fasteners 82, a mastic sealant and/or tape 84 may be used to adhere the lower attachment member 80 to the wall, thereby preventing air flow from passing between the vertical wall and an adjacent surface of the lower attachment member 80. By mechanically affixing and/or sealing the lower attachment member to the building surface, the interface between the back of the channel and the vertical wall of the building is sealed from the air flow.

In some embodiments, such as the embodiments shown in FIGS. 1-7 for example, the lower attachment member 80 and the channel 22 are formed from a single piece of material, such as by folding the material. In an embodiment, best shown in FIG. 1F and FIG. 1G, a fold is formed at the lower attachment member 80. In such embodiments, the lower attachment member 80 may include a first member 90 and a second member 92 formed by bending the sheet of material upon itself. Further, the mastic sealant and/or tape 84 used to seal the lower attachment member 80 of the wall may be located at an exterior surface of the first member 90, closest the to building wall. Although the first member 90 and the second member 92 are illustrated as being oriented generally parallel to one another, it should be appreciated that embodiments where the first and second member 90, 92 are arranged at another angle are also within the scope of the disclosure. As a result of this fold and the thickness of the material, a clearance 94 may be formed between the first and second member 90, 92. In an embodiment, a sealant layer 96 is disposed within the clearance 94 formed between the first and second members 90, 92 of the lower attachment member 80. Although the clearance 94 is illustrated and described herein as being fluidly connected to the interior 30 of the channel 22, it should be appreciated that in other embodiments, the clearance 94 formed between a plurality of members of the lower attachment member 80 may be separate from the interior 30 of the channel 22.

In other embodiments, the lower attachment member 80 is not integrally formed with the channel 22. Rather, as shown in FIGS. 8-14, the lower attachment member 80 is a separate component affixed to the lower surface channel 22, such as to an underside of the channel 22 for example. In such embodiments, the lower attachment member 80 may have a first portion 100 that is connectable to the channel 22, and a second portion 102 that is connectable to the building wall. The first portion 100 of the lower attachment member 80 may be permanently or removably attached to the channel 22 via a fastener, adhesive, sealant, or other suitable connection means 104. Similarly, the second portion 102 may attach to the building wall via a fastener (82), adhesive, sealant, or other suitable connection means (84) as previously described. In an embodiment, such as shown in FIG. 11, the upper attachment member 70 and the lower attachment member 80 may be integrally formed.

Figure 8:
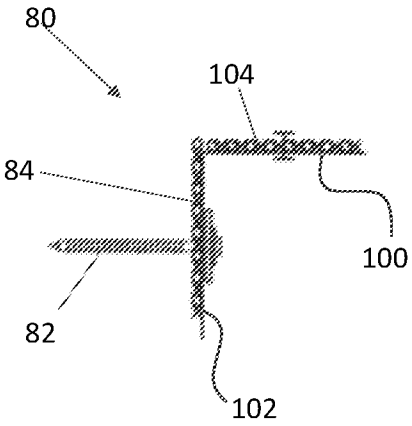
FIG. 8 is a side view of a gutter assembly having a lower attachment member secured to a bottom wall of the channel according to an embodiment.
Figure 8:
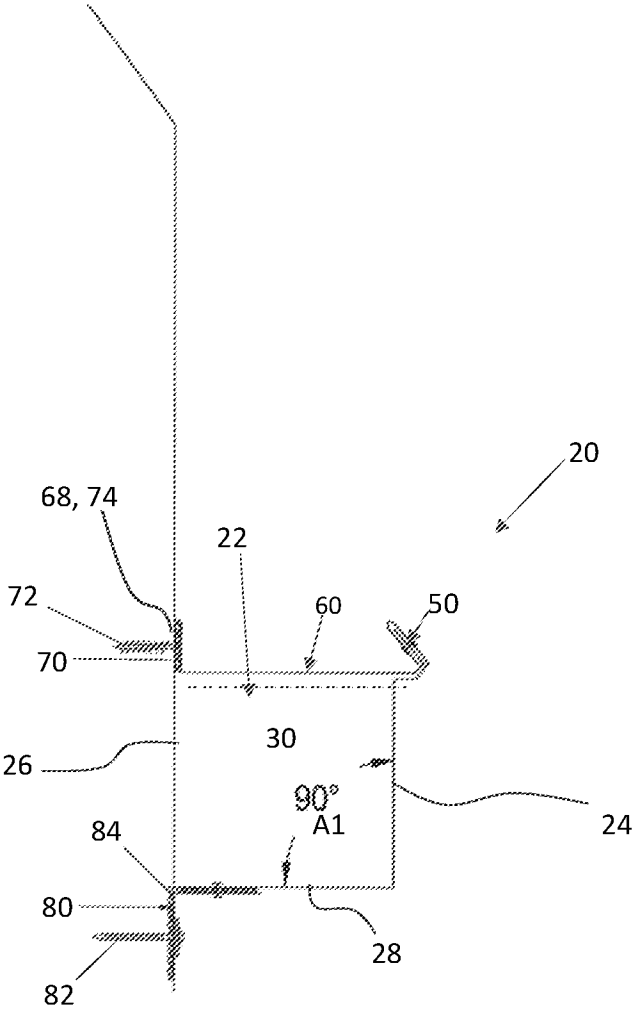
Figure 8A:
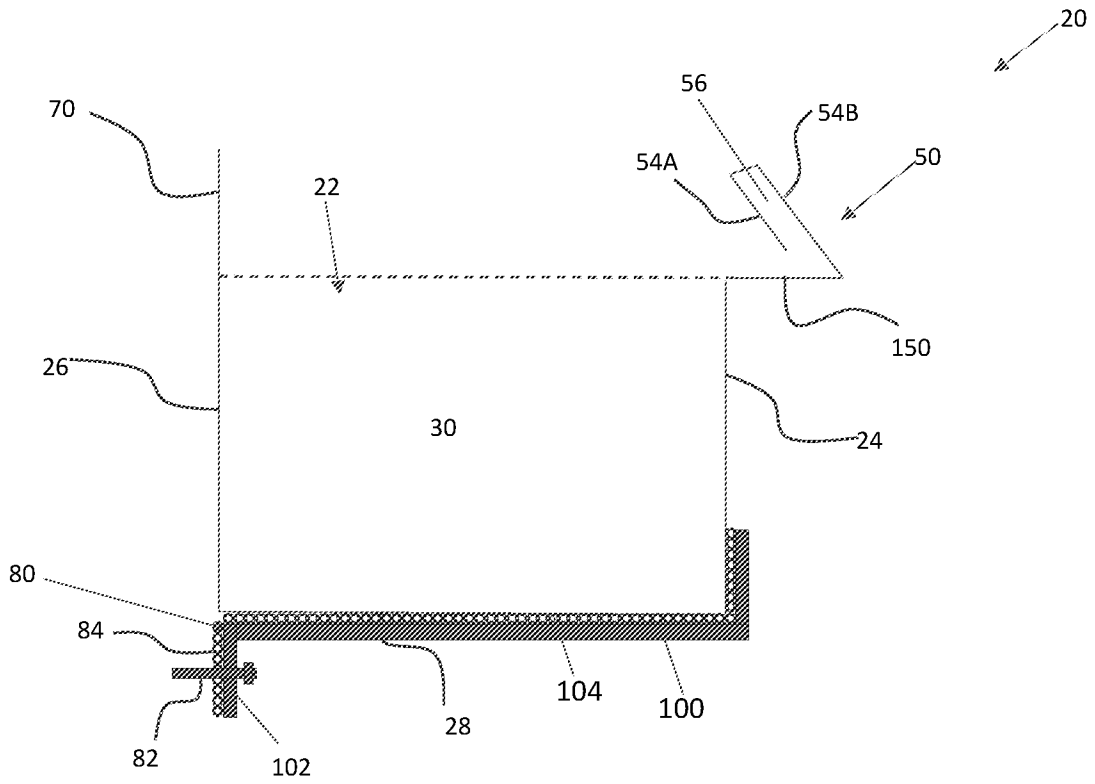
FIG. 8A is a side view of a gutter assembly having a lower attachment member secured to a bottom wall of the channel according to another embodiment.
Figure 9:
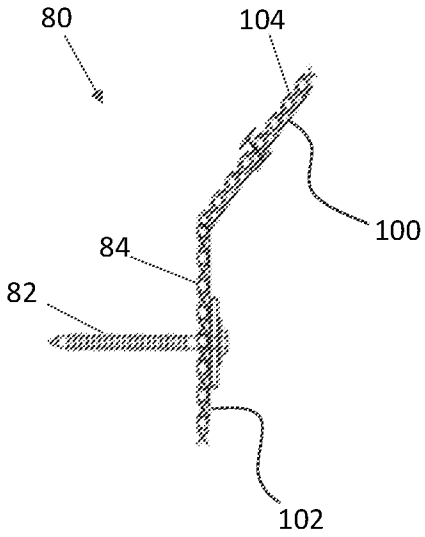
FIG. 9 is a side view of a gutter assembly having a lower attachment member secured to a front wall of the channel according to an embodiment.
Figure 9:
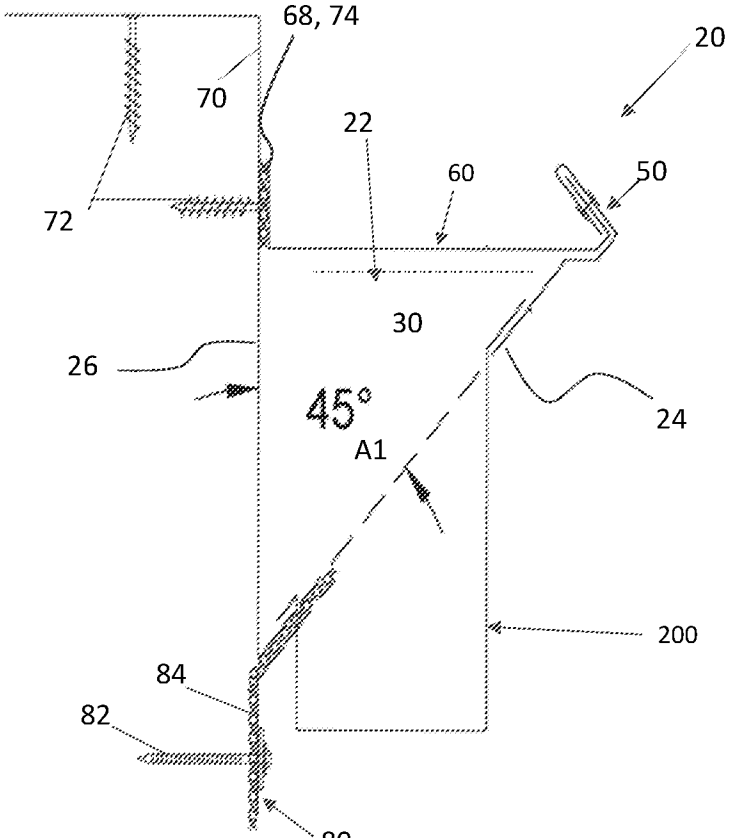

A surface of the second portion 102 connectable to the wall of the structure is typically arranged generally parallel to the wall or surface thereof. The first portion 100 may but need not have a surface oriented parallel to an adjacent surface of the channel 22, such as the bottom wall 28 or the front wall 24 for example. In the illustrated, non-limiting embodiment of FIG. 8, the first portion 100 and the second portion 102 are arranged substantially perpendicular to one another. However, it should be appreciated that the orientation of the first portion 100 may be dependent on the orientation of an adjacent surface of the channel 22. For example, as shown in FIG. 8A, the first portion 100 may have an angle formed therein such that the first portion wraps about the interface between the bottom wall 28 and the front wall 24.

Figure 10:
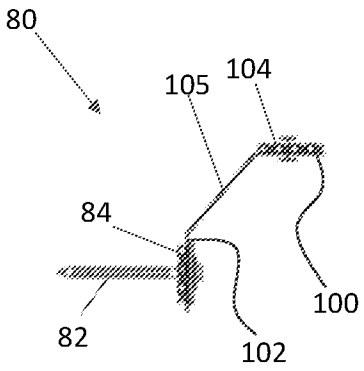
FIG. 10 is a side view of a gutter assembly having a lower attachment member secured to a bottom wall of the channel according to an embodiment.
Figure 10:
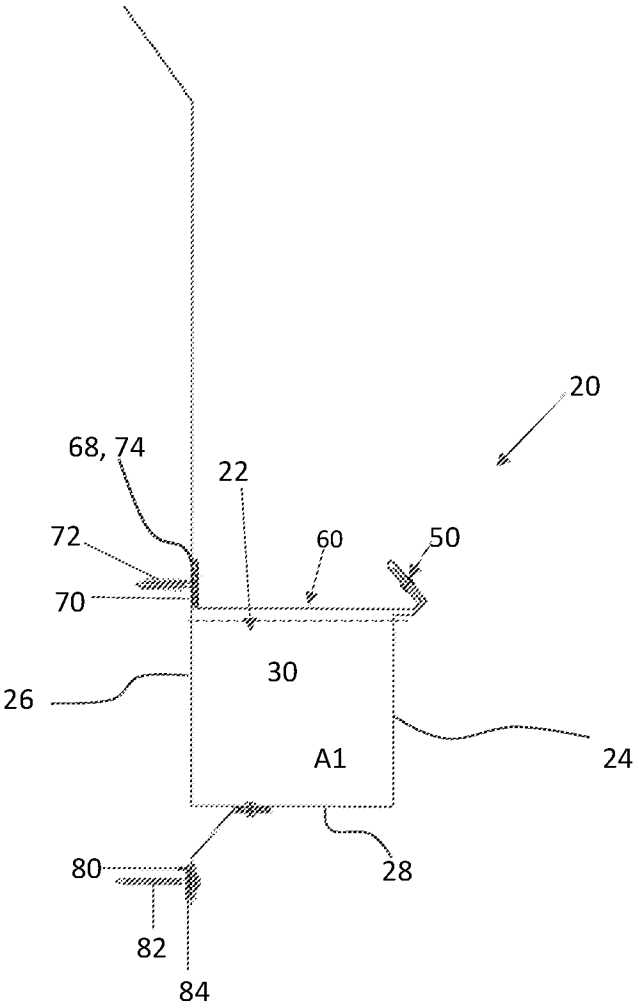

Further, as shown in FIGS. the first portion 100 and the second portion 102 may be integrally formed and directly connected to one another. In other embodiments, such as shown in FIG. 10, the first and second portion 100, 102 of the lower attachment member 80 are connected to one another via a connecting member 105.

Figure 12:
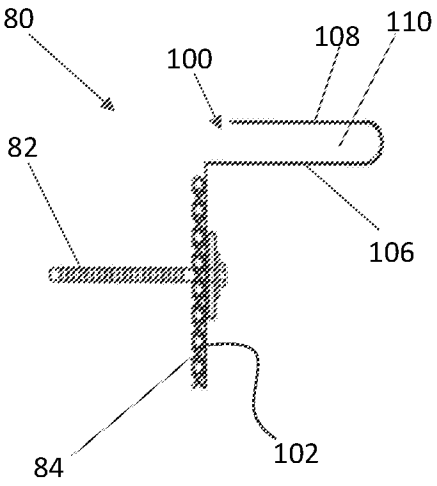
FIG. 12 is a side view of a gutter assembly having a lower attachment member secured to a connector extending from the channel according to an embodiment.
Figure 12:
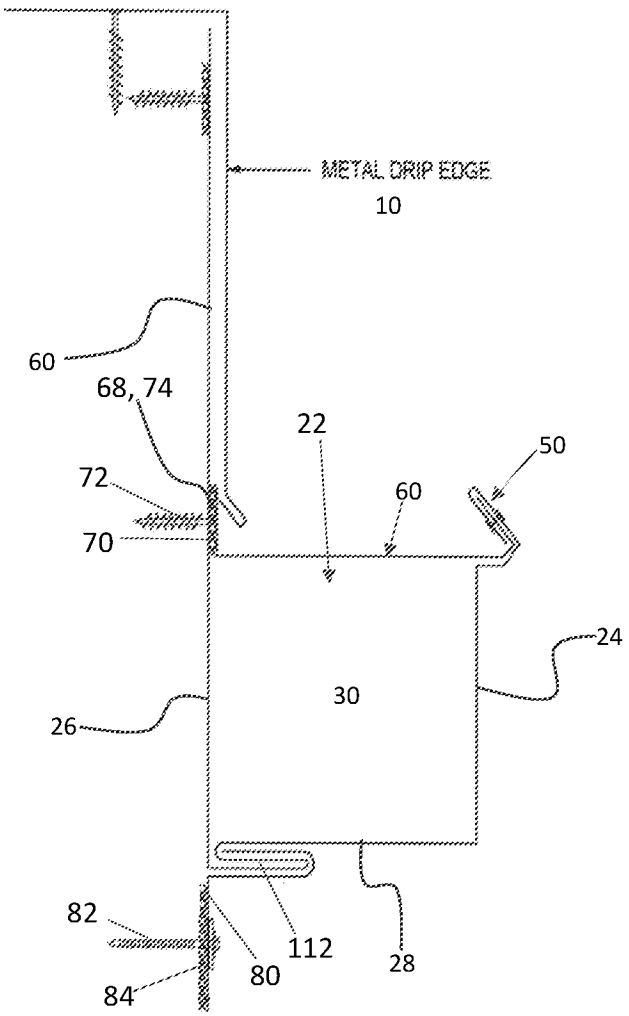
Figure 13:
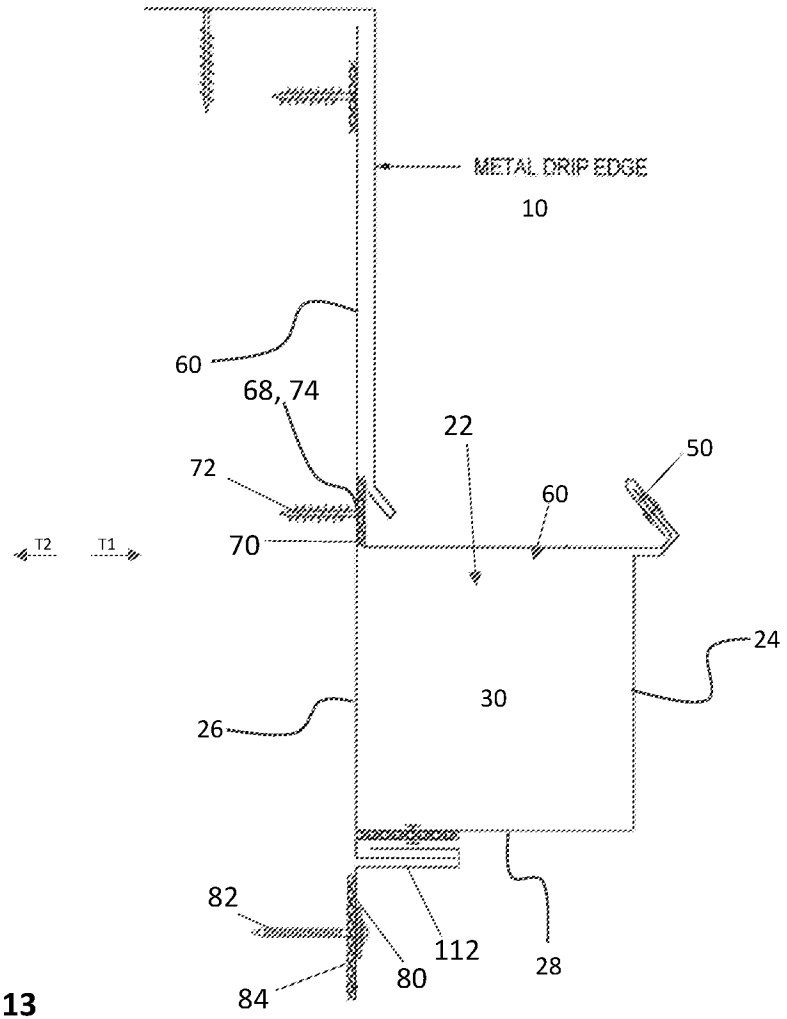
FIG. 13 is a side view of a gutter assembly having a lower attachment member secured to a connector extending from the channel according to an embodiment.

As shown in FIG. 12, in some embodiments the first portion 100 of the lower attachment member 80 defines a first C or U-shaped bracket having a first leg 106 and a second leg 108, and an opening 110 therebetween. A flange or connector 112 extending from the channel 22 may be received within clearance 110 between the first and second legs 106, 108. Through this meshing engagement, motion of the lower attachment member relative to the channel 22 is limited. Although the flange 112 is illustrated as being described as extending from the channel 22 and the U-shaped bracket is illustrated and described as the first portion 100, it should be appreciated that embodiments where the flange is the first portion 100 and the C or U-shaped bracket extends from the channel 22 are also contemplated herein.

Figure 14:
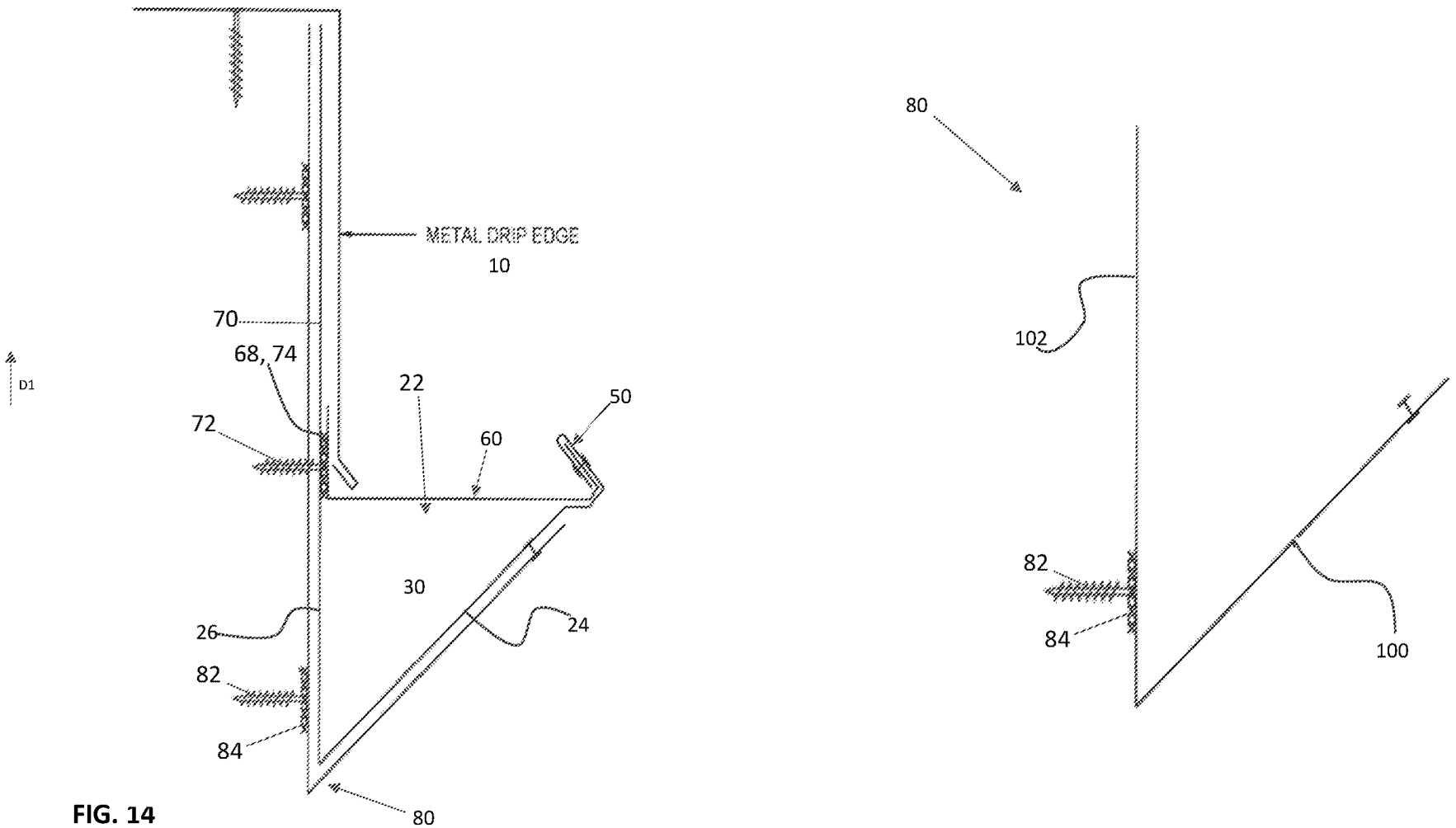
FIG. 14 is a side view of a gutter assembly having a hanger surrounding a back wall and front wall of a channel according to another embodiment.

Turning generally to FIG. 14, aspects of this embodiment differ from those in the previous embodiments only to the extent indicated. In the illustrated, non-limiting embodiment, the second portion 102 of the lower attachment member 80 extends upwardly, such as to the back wall 26, or the upper attachment member 70. Further, the second portion 102 may be oriented parallel to the back wall 26 and/or the upper attachment member 70. The second portion 102 may extend over only a portion or over a substantial entirety of the front wall 24. In the illustrated, non-limiting embodiment, the angle between the first portion 100 and the second portion 102 is substantially equal to the angle between the front wall 24 and the back wall 26.

Downspouts 200 are illustrated in FIGS. 3-6 and 9. It is to be appreciated that downspouts 200 are provided along the gutter assembly 20 in each of the embodiments as required for proper drainage.

The above embodiments provide a trough that is secured to a vertical wall of a building. In some embodiments, the trough is secured both above and below its channel, and in other embodiments the trough may be secured via a hanger that surrounds the channel. The various embodiments provide improved securing of a trough to a wall that can withstand significant winds and water pressures that would otherwise tend to pull the trough away from the wall. In some embodiments, a gutter assembly as illustrated and described herein formed a seal that block or substantially blocks air infiltration into the roof assembly and the building via the connection between the gutter assembly 20 and the windward side of the building. Further, in some embodiments air within the building may be expelled out of the building and the roof assembly at the leeward side (such as opposite the windward side) thereof.

Some embodiments include a drip edge that extends from a top of the vertical wall and over a front portion of the trough, to provide a greater ability to secure the trough to the wall.

'The term "about" is intended to include the degree of error associated with measurement of the particular quantity based upon the equipment available at the time of filing the application.

The terminology used herein is for the purpose of describing particular embodiments only and is not intended to be limiting of the present disclosure. As used herein, the singular forms "a," "an" and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, element components, and/or groups thereof.

While the present disclosure has been described with reference to an exemplary embodiment or embodiments, it will be understood by those skilled in the art that various changes may be made and equivalents may be substituted for elements thereof without departing from the scope of the present disclosure. In addition, many modifications may be made to adapt a particular situation or material to the teachings of the present disclosure without departing from the essential scope thereof. Therefore, it is intended that the present disclosure not be limited to the particular embodiment disclosed as the best mode contemplated for carrying out this present disclosure, but that the present disclosure will include all embodiments falling within the scope of the claims.

What is claimed is:

1. A gutter assembly for a structure, comprising:

a channel having a hollow interior;

a lower attachment member connectable to the structure, the lower attachment member being affixed to a lower surface of the channel and extending continuously over a length of the channel; and wherein the lower attachment member is integrally formed with the channel and includes a first member and a second member separated by a clearance, and a sealant layer arranged within the clearance.

2. The gutter assembly of claim 1, wherein the channel and the lower attachment member are formed from a bent piece of sheet metal.

3. The gutter assembly of claim 1, wherein the lower attachment member is removably coupled to the channel.

4. The gutter assembly of claim 3, wherein the lower attachment member includes a first portion and a second portion, the first portion being affixed to the lower surface of the channel and the second portion being connectable to the structure.

5. The gutter assembly of claim 4, wherein the first portion and the second portion are integrally formed.

6. The gutter assembly of claim 4, wherein the channel further comprises a back wall and a front wall and the first portion is affixed to the front wall.

7. The gutter assembly of claim 4, wherein the channel further comprises a back wall, a front wall, and a bottom wall extending between the back wall and the front wall, the first portion being affixed to the bottom wall.

8. The gutter assembly of claim 4, further comprising a connector extending from the lower surface of the channel, wherein the first portion has a bent configuration defining a clearance and at least a portion of the connector is arranged within the clearance.

9. The gutter assembly of claim 1, further comprising a plurality of fasteners for connecting the lower attachment member to the structure.

10. The gutter assembly of claim 1, further comprising a sealant arranged at a surface of the lower attachment member facing towards the structure.

11. A building comprising:

a vertical wall;

a gutter assembly mounted to the vertical wall, wherein an interface between the gutter assembly and the vertical wall is sealed such that wind cannot flow between the gutter assembly and the vertical wall; and wherein the lower attachment member is integrally formed with the channel and includes a first member and a second member separated by a clearance, and a sealant layer arranged within the clearance.

12. The building of claim 11, wherein the gutter assembly further comprises at least one attachment member for mechanically affixing the gutter assembly to the vertical wall.

13. The building of claim 12, wherein the gutter assembly further comprises a channel and the at least one attachment member further comprises a lower attachment member connected to a bottom of the channel.

14. The building of claim 11, wherein the lower attachment member is removably connected to the channel.

15. The building of claim 14, wherein the channel includes a back wall and a front wall, the lower attachment member being coupled to the front wall.

16. The building of claim 14, wherein the channel includes a back wall, a front wall, and a bottom wall extending between and connecting the back wall and the front wall, the lower attachment member being coupled to the bottom wall.

* * * * *